United States Patent [19]

Ratzeburg

[11] 4,239,500

[45] Dec. 16, 1980

[54] PROCESS FOR THE UTILIZATION OF WASTE PRODUCT TAR-DUST IN GASIFICATION OF GRANULAR FUEL UNDER PRESSURE, ESPECIALLY OF BITUMINOUS COAL

[75] Inventor: Wolfgang Ratzeburg, Essen, Fed. Rep. of Germany

[73] Assignee: Steag A.G., Essen, Fed. Rep. of Germany

[21] Appl. No.: 20,335

[22] Filed: Mar. 14, 1979

Related U.S. Application Data

[63] Continuation-in-part of Ser. No. 852,146, Nov. 16, 1977, abandoned, which is a continuation-in-part of Ser. No. 720,254, Sep. 3, 1976, abandoned.

[51] Int. Cl.[3] ..... C10J 3/16

[52] U.S. Cl. ..... 48/202; 44/10 C; 48/210; 201/6

[58] Field of Search ..... 48/77, 76, 86 R, 101, 48/210, 202, 197 R, 206; 201/5, 6, 22, 25; 44/10 C

[56] References Cited

U.S. PATENT DOCUMENTS

| | | | |
|---|---|---|---|
| 3,540,867 | 11/1970 | Baron et al. | 48/197 R |
| 3,692,505 | 9/1972 | Reichl | 201/6 |
| 4,049,392 | 9/1977 | Furman | 44/10 R |

FOREIGN PATENT DOCUMENTS

| | | | |
|---|---|---|---|
| 988301 | 5/1976 | Canada | 44/10 C |
| 2540165 | 3/1977 | Fed. Rep. of Germany . | |
| 547114 | 8/1942 | United Kingdom | 201/6 |

*Primary Examiner*—Raymond N. Jones
*Assistant Examiner*—George C. Yeung
*Attorney, Agent, or Firm*—Wilson, Fraser, Barker & Clemens

[57] ABSTRACT

A process for the utilization of tar-dust which is separated from the gases derived from gasification of granular fuel under pressure, especially of bituminous coal, and in which the tar-dust separated from the gases is fed back into the pressure gasification cycle of the fuel. The tar-dust is added as a binder in the pelletization of the fine grained portions of the fuel and is fed in pellet form into the generator. Apparatus for carrying out the process comprises a pressure generator having a feed device for granular fuel, a tar-dust separator, and a pelletizing device connected by a tar-dust coveying pipe to the tar-dust separator, for the pelletizing of fine grains of fuel with tar-dust as a binder, the pelletizing device conveying the green pellets produced thereby into the feed device. The granular fuel is screened to pass only that portion below a predetermined grain size to the pelletizer, the remaining portion being fed directly to the generator.

3 Claims, 1 Drawing Figure

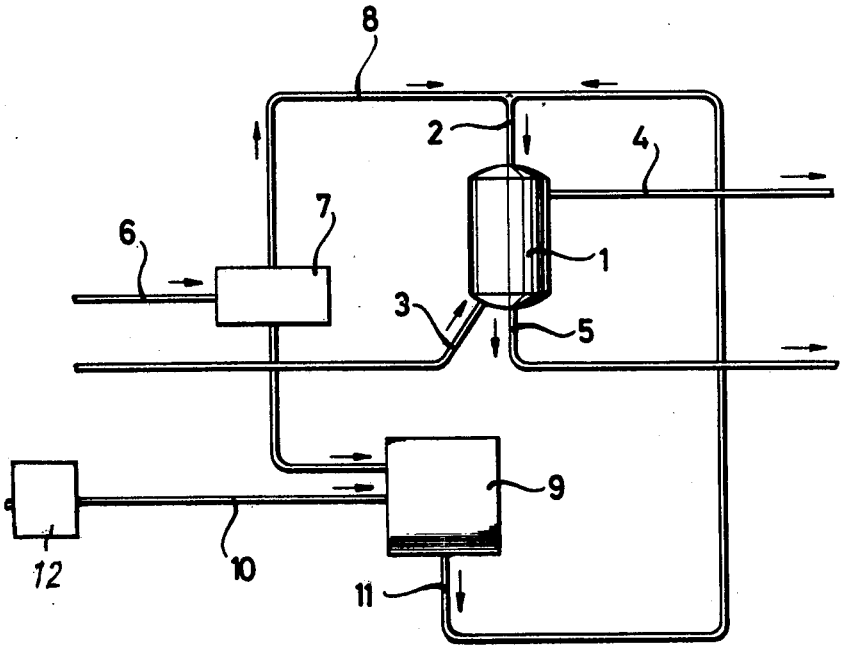
8
2
4
7
6
1
3
5
9
12
10
11

PROCESS FOR THE UTILIZATION OF WASTE PRODUCT TAR-DUST IN GASIFICATION OF GRANULAR FUEL UNDER PRESSURE, ESPECIALLY OF BITUMINOUS COAL

CROSS REFERENCE TO RELATED APPLICATION

This application constitutes a continuation-in-part of application, Ser. No. 852,146 filed Nov. 16, 1977, now abandoned, which is a continuaton-in-part of application, Ser. No. 750,254, filed Sept. 3, 1976, now abandoned, entitled PROCESS AND PLANT FOR THE UTILIZATION OF TAR IN GASIFICATION OF GRANULAR FUEL UNDER PRESSURE, ESPECIALLY OF BITUMINOUS COAL.

BACKGROUND OF THE INVENTION

The invention relates to a process of the utilization of tar-dust which is a waste product separated from the gases derived from gasification under pressure of granular fuel, especially of bituminous coal, whereby the waste tar-dust is fed back into the pressure gasification cycle of the fuel for cracking of the tar and additional heat values. The tar-dust waste product is a very viscous product resembling shoe polish in its appearance.

In a known process (DL-PS 74071) separated hydrocarbons, especially tar and tar-dust, are heated and introduced into the reaction or conversion zone of a generator for the gasification of granular fuel. Here the hydrocarbons are broken down in the presence of hydrogen. The process has the advantage that the tar arising during the process of pressure gasification is included. Thus the gas is enriched by the low boiling hydrocarbons obtained from the tar. For this reason, the gas leaves the generator with a higher calorific value. Of course, the introduction of the tar into the generator causes considerable difficulties. Among other things, the tar, which is generally highly viscous, has to be forced through pipes into the generator with the aid of pumps.

Another problem with the operating of generators for pressure gasification arises from the dust content of the generated gas. Its dust content is increased with the increase of undersize granules (i.e., of 0–2 mm grain size) in the fine coal which is fed to the generator. Up to 70% of the coal obtained by the usual extraction and preparation methods is likely to be undersize. For this reason, the fine coal must be graded before it is fed to the generator so that the coal fed to the generator has generally a grain size of 2–30 mm. Use of coal having a lower grain size than this leads to an undesirable high dust content in the gas generated. Furthermore, it leads to a poor draught in the standing pillar of fuel in the body of the generator.

The tar-dust has previously been laboriously pumped and fed to the top of the gasifying unit in an attempt to crack the tar. Not only are the pipe lines often blocked, but the pumping efficiency is poor. However, gasification in this case is occurring above the top of the coal column and no cracking takes place. In fact, the net effect of this recycling is a big increase in the tar-dust mixture to be removed with no increase in heat values.

It has also been suggested to pump the tar-dust into a lower stage in the gasifier. Of course, pumping problems are still present. However, no considerable cracking of tar is obtained by this method for the tar is condensed in the upper and colder coal seams so that again the tar is recycled with no cracking.

SUMMARY OF THE INVENTION

The object of the invention is to simplify the recycling of the tar-dust into the generator, to reduce the undersize granulation in the material fed to the generator, and to crack the recycled tar in tar-dust.

In coal gasification, especially gasification under pressure, high heat values can be obtained. However, the conditions are not always adequate to crack the tar in the coal. This tar, along with very fine coal, termed dust, is carried out of the gasification unit and separated from the gases in a tar-dust separator. This is a waste product. In other processes it is known to distill coal tar to separate fractions. The dark residue obtained by the fractional distillation of tar is pitch. However, the tar-dust waste product in the instant invention does not undergo any separation to pitch and the waste product is not equivalent to pitch.

This task is solved according to the invention in that the tar-dust is added as a binder in a pelletizing of the undersized portion of the fuel and is brought into the generator as a constituent of the green unheated pellets. The green unheated pellets, unsatisfactory for conventional purposes, surprisingly serve as a transporting medium for the tar obtained from the pellets. By transporting medium it is meant that the tar is transported by means of the pellets intermingled with the fuel coal to the lower section of the gasifier and in this form, the tar is in dispersed form. In this way, the tar reaches the hot zone of the gasifier in condition for cracking and is cracked in this hot zone.

This process has the advantage of eliminating the pumping equipment and pipelines with their myriad problems. Moreover, the pellets agglomerize the fine coal particles rendering them useable without increasing the dust content of the generated gas. Additionally, the pellets behave like the other pieces of fuel and tar is delivered into the reaction zone of the gasifier which has a sufficient temperature to crack the tar. It is to be appreciated that cracking does occur when the tar is introduced into the lower hotter reaction zone of the gasifier as a constituent of a pellet. Tar introduced solely as a tar-dust waste product into the lower reaction zone is distilled and condenses on the upper and colder coal seams. It is believed that through pelletization, the tar is in very fine portions throughout the coal column as the pellets are mixed with the rest of the fuel. Moreover, generally it is believed that the tar is held together by forces of adhesion, also known as "Van der Waals" forces, by cohesion forces and capillar effects to the fine coal and that these forces are strong enough to prevent distillation in the upper colder coal seams. Reaching the lower hotter reaction zone, the tar, dispersed in the pellets, undergoes cracking at the higher temperatures.

The green pellets are formed by mixing the tar-dust with small grain sizes of fine coal at ambient temperatures. The mixing proportions are sufficient to form pellets of suitable size for pressure gasification.

The techniques for pelletization are well known in the art. The ratio of binder to fine coal can vary greatly. Generally, the ratio varies between 12% to 28%, tar-dust binder to fine coal. This, too, is dependent on the amount of tar in the tar-dust binder. In the practice of the instant invention, fewer fines are carried over with the gas and the percentage of tar in the tar-dust is higher than in conventional operations. The percentage of tar, by weight in the tar-dust may vary between 37 and 77 percent.

Surprisingly, these green pellets, although having little mechanical strength, are sufficiently adhesive to reach the hot seams in the coal column. Conventional pelletization procedures employ other processes or ingredients to produce a stronger, coked or partially coked pellet.

For practice purposes, the fuel is graded before pelletizing, e.g., in order to exclude the coarse proportion which can be used for gasifying without the necessity of pelletization.

The pelletization process preferably uses the undersize grains of 0–2mm grain size. The pellets themselves have, however, the required size for pressure gasification, preferably about 20 mm. Thus, they correspondingly reduce the dust carried out in the generator gas. The reduction of the dust content makes it possible for the gas scrubbing plant which follows the generator in process sequence, to be smaller than hitherto. Also, the mixture obtained from the scrubber, which consists of tar-dust, exhibits a more favorable tar-dust ratio from hitherto. The higher proportion of tar in the tar-dust binder is beneficial in forming the pellets. The incidence of dust when loading the fuel into the generator is also reduced.

Apparatus for carrying out the process described, comprises a pressure generator having a feed device for granular fuel, a tar-dust separator, and a pelletizing device which is connected by at least one tar-dust conveying pipe to the tar-dust separator for the addition of binder to the granular fuel, which pelletizing device conveys the pellets produced thereby into the feed device. The pelletizing device may include at least one pelletizing plate. A screen can be located before the pelletizing device, which screen is preferably formed as a tensionable screen.

BRIEF DESCRIPTION OF THE DRAWING

The single FIGURE is a schematic lay-out of a pressure gasification process with a return tar-dust feed.

DESCRIPTION OF THE PREFERRED EMBODIMENT

A pressure generator 1 receives granular fuel, namely coal, at 2 and, as gasification medium, steam at 3. The generator produces gas by reaction with the fuel, which gas leaves the generator 1 at 4. The ash resulting is removed at 5.

The fuel required for the operating of the generator 1 consists of fine coal with a granular grading of 0–30 mm grain size. This is delivered onto a tensionable screen 7 by means of a conveyor 6, which screen separates the granular sizes 0–3 mm grain size from the coarse proportion of 3–30 mm grain size. The fuel remaining on the screen (3–30 mm grain size) is fed directly into the generator by a conveyor 8. The fine coal passing through the screen (0–3 mm grain size) arrives on a pelletizing plate 9. On this plate, pellets are produced from the fine coal with tar-dust serving as a binder. The tar-dust comes from a tar-dust separator 12 which is located in line after the generator 1. The tar-dust flows through a pipe 10 from the separator 12 and arrives on the pelletizing plate 9. The pellets, which are in what is known as the "green" condition, are brought to the generator 1 by a conveyor 11 and are fed as unheated green pellets into the generator 1.

The forming of pellets outside of the gasification unit with the waste product tar-dust is significant. Not only are waste products utilized to enrich the gas, but the utilization is done in such a manner as to obviate troublesome pumping equipment to the gasifier and bothersome dust in the gasifier. It is wholly unexpected that pellets produced by agglomerization of coal fines and tar-dust would be strong enough to reach the lower zone of a coal column for tar cracking.

What I claim is:

1. In the process of gasifying coal be feeding particulate coal and steam into a pressure generator for interreaction therein to produce a gas effluent containing tar-dust, and recycling the tar-dust produced thereby, the improvement comprising:

(a) feeding said coal into a separator, thereby producing a first portion of relatively large particle size and at least a second portion of relatively small particle size, (b) feeding steam and said first portion of relatively larger particle size into said generator to crack the coal particles and produce effluent gas from the generator containing tar-dust as a waste product, (c) recovering said tar-dust from said effluent gas and admixing said tar-dust with said second portion of particulate coal feed of relatively smaller particle size to bind the latter into pellets of sufficient weight whereby they are capable of being conveyed to a lower zone of said pressure generator, and (d) feeding said pelletized second portion of relatively smaller particle size and tar-dust to the upper portion said pressure generator concurrently with said first portion of particulate coal of relatively larger particle size, causing said pelletized second portion to pass downwardly in said pressure generator to a lower zone thereof, whereby the tar, dispersed in the pellets, undergoes cracking at high temperatures upon reaching the lower zone of said pressure generator.

2. A process as claimed in claim 1, comprising grading granular bituminous coal into fine coal of the order of size of 0–3 mm and coarse coal of the order of size 3–30 mm, feeding the coarse coal directly to the pressure generator free of the said fine coal, and feeding the fine coal to a pelletizer to form pellets at normal temperatures.

3. A process of claim 1 wherein the ratio of tar-dust binder to fine coal varies by weight between 12 to 28%.

* * * * *